US006123227A

United States Patent [19]

Umeda

[11] Patent Number: 6,123,227

[45] Date of Patent: Sep. 26, 2000

[54] GAS GENERATING APPARATUS FOR EMERGENCY REFUGE IMPLEMENTS

[75] Inventor: Makoto Umeda, Kumamoto, Japan

[73] Assignee: Safety Co., Ltd., Kumamoto, Japan

[21] Appl. No.: 09/233,069

[22] Filed: Jan. 19, 1999

[30] Foreign Application Priority Data

Oct. 27, 1998 [JP] Japan ..... 10-343517
Oct. 27, 1998 [JP] Japan ..... 10-343518

[51] Int. Cl.[7] ..... B67B 7/24

[52] U.S. Cl. ..... 222/5; 222/83

[58] Field of Search ..... 222/3, 5, 87, 83, 222/83.5; 441/41, 93, 94, 96, 99

[56] References Cited

U.S. PATENT DOCUMENTS 3,938,704 2/1976 Milgram ..... 222/5
4,475,664 10/1984 Mackal ..... 222/5
4,498,604 2/1985 Mackal ..... 222/5
4,498,605 2/1985 Mackal et al. ..... 222/5

*Primary Examiner*—J. Casimer Jacyna
*Attorney, Agent, or Firm*—Wenderoth, Lind & Ponack, L.L.P.

[57] ABSTRACT

A gas generating apparatus for emergency refuge implements includes a gas generator body, a gas cartridge arrange in the gas generator body, a firing pin disposed opposite to the gas cartridge in the gas generator body, and a slider disposed slidably in the gas generator body. A movable ball-shaped pin is inserted through an opening formed in the gas generator body into an arcuate recess formed in the slider to maintain the slider at a standstill position. A pulling rope with a knob is connected to the movable ball-shaped pin to release the movable ball-shaped pin from the arcuate recess of the slider. A spring always presses the slider. When the movable ball-shaped pin is released from the arcuate recess of the slider, the firing pin and the gas cartridge are impacted to each other by moving the slider due to the pressure of the spring, thus to discharge the gas from the gas cartridge.

11 Claims, 4 Drawing Sheets

GAS GENERATING APPARATUS FOR EMERGENCY REFUGE IMPLEMENTS

BACKGROUND OF THE INVENTION

1. Industrial Field of the Invention

This invention relates to a gas generating apparatus for emergency refuge implements to generate the gas for pouring into a life jacket, life boat, life buoy, air pump for tires of motor bicycle and vehicle, and air bag at the time of emergency and disaster in sea accidents and land accidents.

2. Prior Arts

The conventional gas generating apparatus of hand-operated type of this sort is very large, and has heavy weight, and further the user has to pull a manipulating knob to the predetermined directions, such as the upward and downward directions and the left and right side directions.

In the above-mentioned conventional gas generating apparatus, there is such problems that it is too late for the gas generation in case of an emergency, since the gas generating manipulation is very complicated, has much troubles and takes any times, and that it is impossible for children and women to utilize the gas generating apparatus, as the manipulation is much troublesome works for them. Further, there is also such problems that it is inconvenient and difficult to attach it to the emergency refuge implements, such as a life jacket, life buoy, air pump and air bag, as the conventional gas generating apparatus is very large and has heavy weight.

SUMMARY OF THE INVENTION

It is an object of this invention in order to resolve the problems of the prior art mentioned above to provide a gas generating apparatus of small type and great convenience for dealing with the disasters by filling up the gas into the emergency refuge implements preserved previously to the sea and land accidents.

It is other object of this invention to provide a gas generating apparatus for emergency refuge implements comprising a small and light gas generator body, from which anyone can generate easily and rapidly the gas by merely pulling a rope with knob to the discretional and various directions without conducting much troublesome manipulation in case of the emergency.

A gas generating apparatus for emergency refuge implements according to this invention comprises a gas generator body, a gas cartridge arranged in said gas generator body, a firing pin disposed opposite to said gas cartridge in the gas generator body, a slider provided slidably in the gas generator body, a movable ball-shaped pin inserted through an opening formed in the gas generator body into an arcuated recess formed in the slider to maintain the slider to a standstill position, a pulling rope with knob connected to the movable ball-shaped pin to remove the movable ball-shaped pin from the arcuated recess of the slider, and a spring for pressing always the slider at the standstill position, wherein either one of the gas cartridge and firing pin is mounted to the slider and other is fixed to the gas generator body.

According to one aspect of the gas generating apparatus for emergency refuge implements of this invention, a gas generator body comprises a spring receiving portion containing a spring and a gas cartridge receiving portion including slidably a gas cartridge and a slider which are connected to each other and are pressed respectively by said spring, said gas cartridge receiving portion is provided at the end portion with a firing pin mounted opposite to the gas cartridge and a gas discharging member mounted adjacent to said firing pin, a movable ball-shaped pin is removably inserted through an opening formed in the gas cartridge receiving portion into an arcuated recess formed in the slider to maintain the slider to a standstill position, and a pulling rope with knob is connected to said movable ball-shaped pin.

According to other aspect of a gas generating apparatus for emergency refuge device of this invention, a gas generator body comprises a slider receiving portion having a gas cartridge and a gas discharging member mounted in one side and including slidably a slider with a firing pin projected opposite to the gas cartridge in other side and a spring receiving portion including a spring for pressing the slider, a movable ball-shaped pin is removably inserted through an opening formed in the slider receiving portion into an arcuated recess formed in the slider to maintain the slider to a standstill position, and a pulling rope with knob is connected to said movable ball-shaped pin.

DETAILED DESCRIPTION OF THE PREFERRED EMBODIMENT

Figure 1:
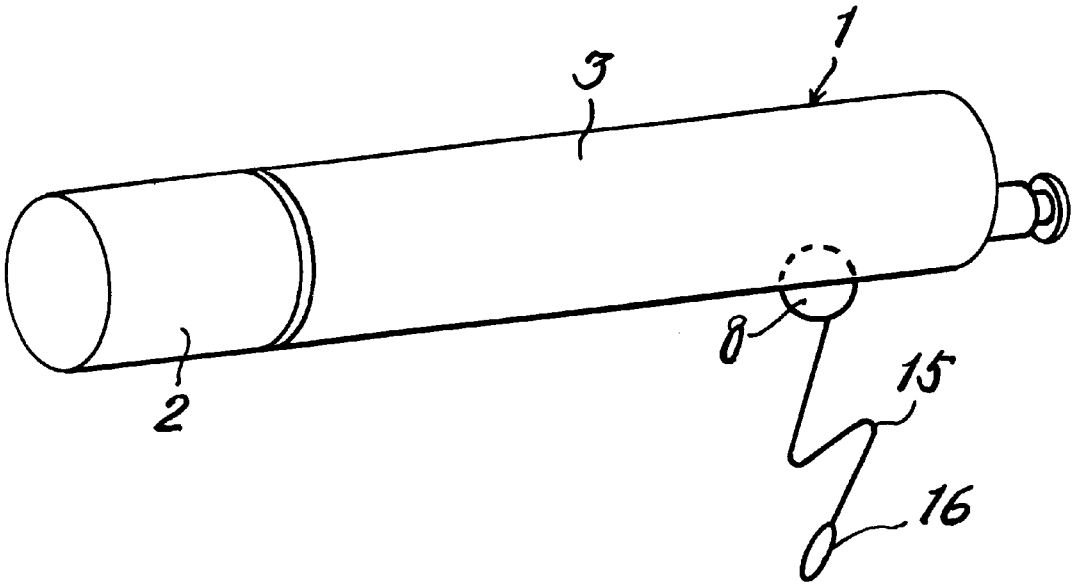
FIG. 1 is a perspective view of a gas generating apparatus according to a first embodiment of this invention.
Figure 2:
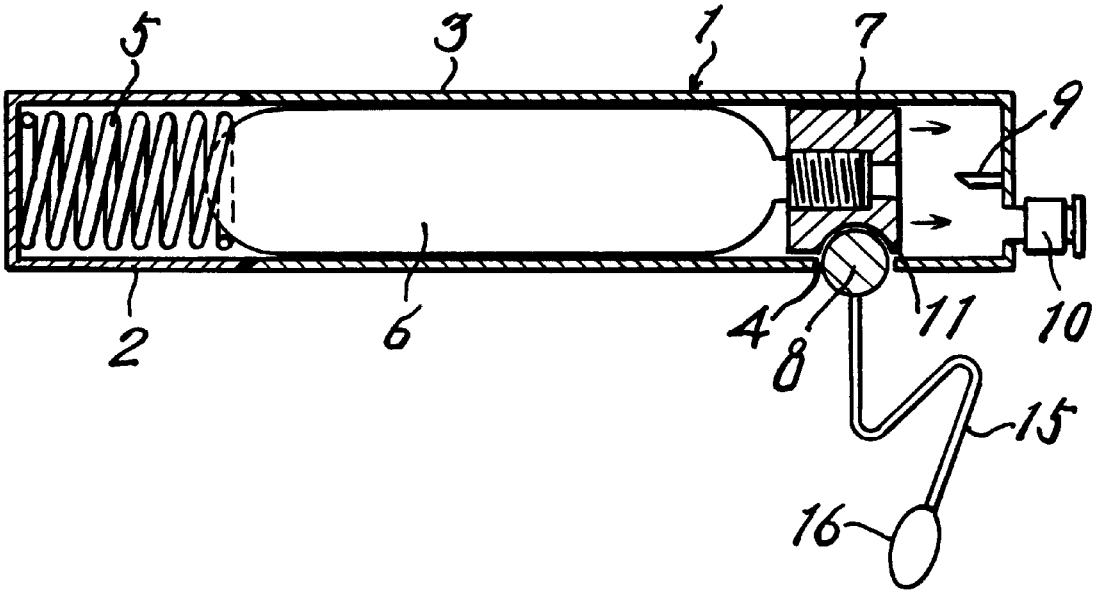
FIG. 2 is a vertical longitudinal sectional view of the first embodiment shown in FIG. 1.
Figure 3:
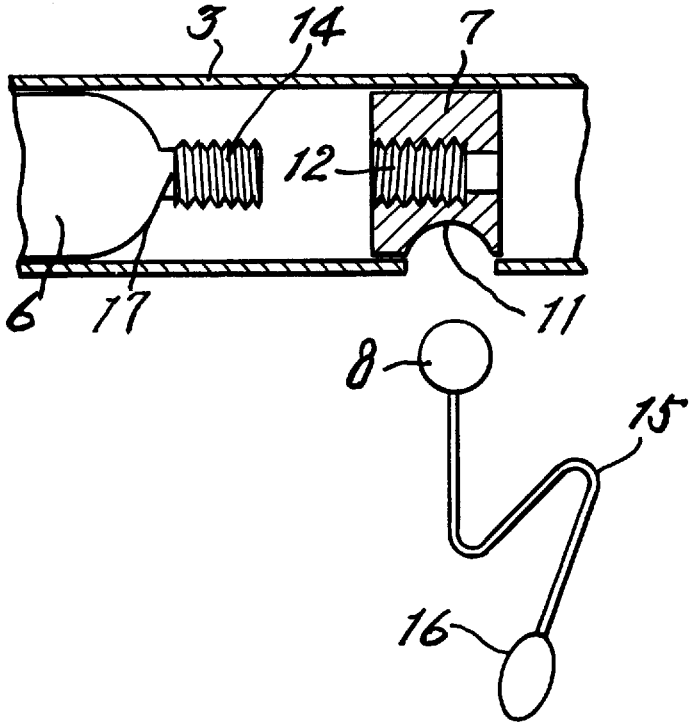
FIG. 3 is an exploded sectional view of one portion of FIG. 2.

In the first embodiment of the gas generating apparatus of this invention shown in FIG. 1 to FIG. 3, a gas generator body 1 is made of a component of stainless steel, aluminum, or synthetic resin for the purpose of light weight and comprises a spring receiving portion 2 and a gas cartridge receiving portion 3 which are connectable to each other. The spring receiving portion 2 includes a spring 5 for pressing a gas cartridge 6 and a slider 7 attached to said gas cartridge 6.

The gas cartridge receiving portion 3 includes slidably the gas cartridge 6 and the slider 7 which are pressed by the spring 5. Further the gas cartridge receiving portion 3 is provided at the end portion with a firing pin 9 projected inwardly opposite to the gas cartridge 6 and with a gas discharging member 10 mounted adjacent to said firing pin 9.

The gas cartridge 6 is provided with a neck 17 having an outer screw thread portion 14, said neck 17 is provided at the end portion with a membrane which is broken by the firing pin 9, and the gas cartridge 6 is contained mainly with carbonic acid gas (CO), or nitrogen gas (N) in the inside. The slider 7 has an inserting slot 12 bored in the center portion, the inserting slot 12 is provided with an inner screw thread portion 13, and thus the gas cartridge 6 is mounted to the slider 7 by engaging threadedly the outer screw thread portion 14 of the neck 17 with the inner screw thread portion 13 of the inserting slot 12 as shown in FIG. 3. When the gas cartridge 6 and slider 7 are pressed by the spring 5 toward the firing pin 9, the slider 7 strikes the neck 17 of the gas cartridge 6 against the firing pin 9 through the inserting slot 12, and the membrane of the neck 17 is broken by the firing pin 9 to generate the gas from the gas cartridge 6.

The slider 7 has an arcuated recess 11 formed in the periphery, and the gas cartridge receiving portion 3 has a circular opening 4 bored in the peripheral wall. A movable ball-shaped pin 8 is inserted through the opening 4 of the gas cartridge receiving portion 3 into the arcuated recess 11 of the slider 7, and the slider 7 and gas cartridge 6 are maintained to a standstill position spaced from the firing pin 9 at the condition pressed by the spring 5 to the direction shown by arrow mark in FIG. 2.

Figure 7:
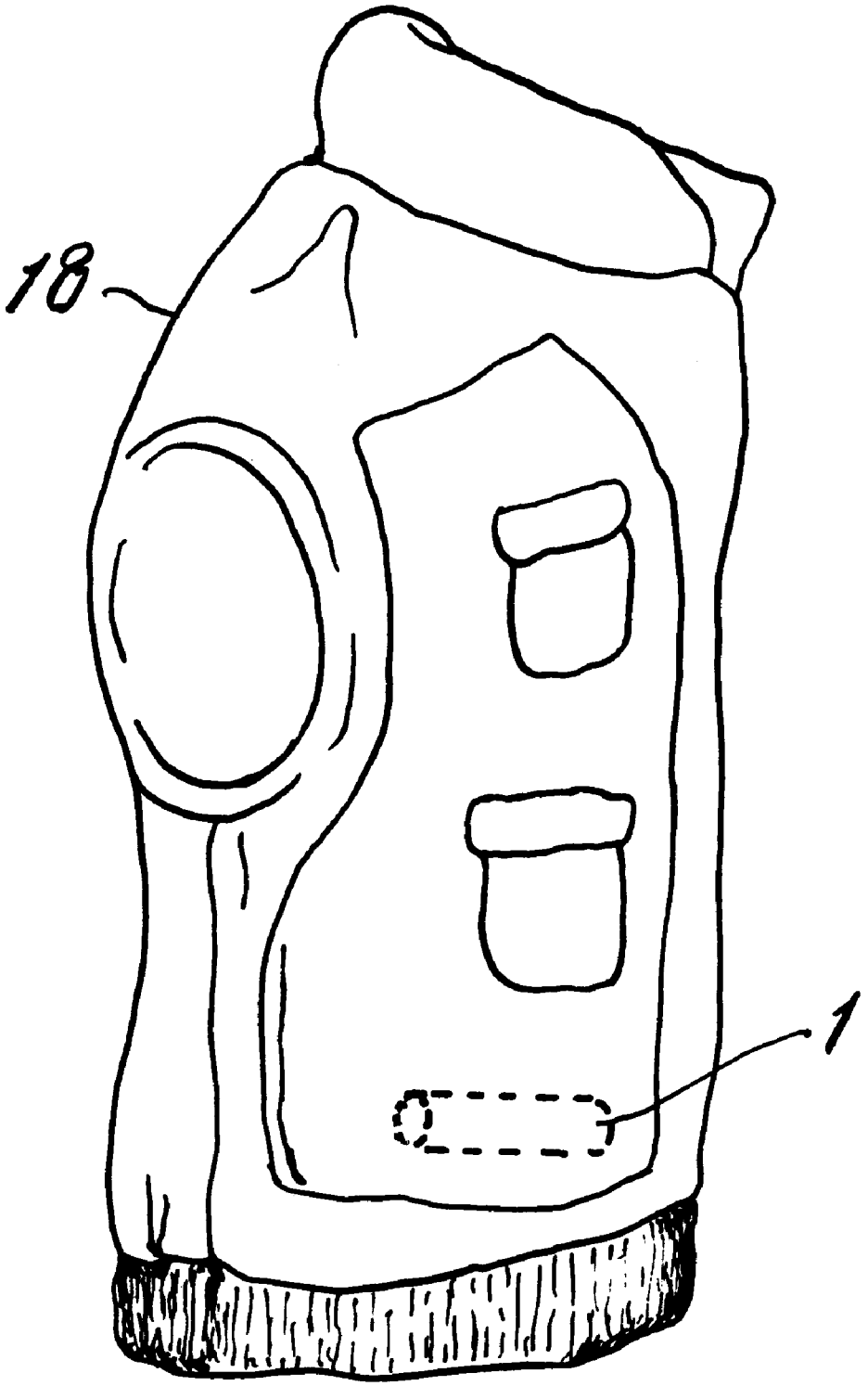
FIG. 7 is a side view of a life jacket to which a gas generating apparatus of this invention is mounted.

A pulling rope 15 is connected to the circular surface of the movable ball-shaped pin 8 and has a knob 16 mounted to the end portion to remove the movable ball-shaped pin 8 from the arcuated recess 11 of the slider 7 by pulling it to the various directions. The gas generator body 1 of this invention is adapted to be attached to the emergency refuge devices, for example a life jacket 18 as shown in FIG. 7.

When the user put on the life jacket 18 to which the gas generator body 1 is attached and has pulled the knob 16 of the pulling rope 15 in case of the emergency and disaster, the movable ball-shaped pin 8 is removed from the accuated recess 11 of the slider 7, said slider 7 advances together with the gas cartridge 6 under the pressure of the spring 5 toward the firing pin 9 and strikes the membrane of the neck 17 of the gas cartridge 6 against the firing pin 9 through the inserting slot 12, and consequently the membrane of the neck 17 is broken and the gas in the gas cartridge 6 is automatically poured into the life jacket 18 through the gas discharging member 10 to give the floaty force to the life jacket 18.

Figure 4:
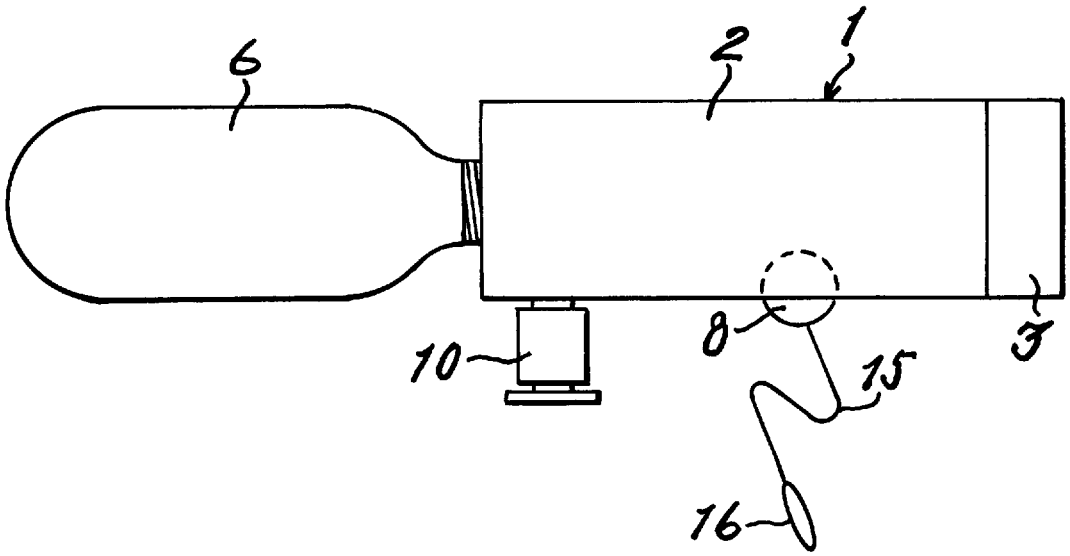
FIG. 4 is an elevational view of a gas generating apparatus according to a second embodiment of this invention.
Figure 5:
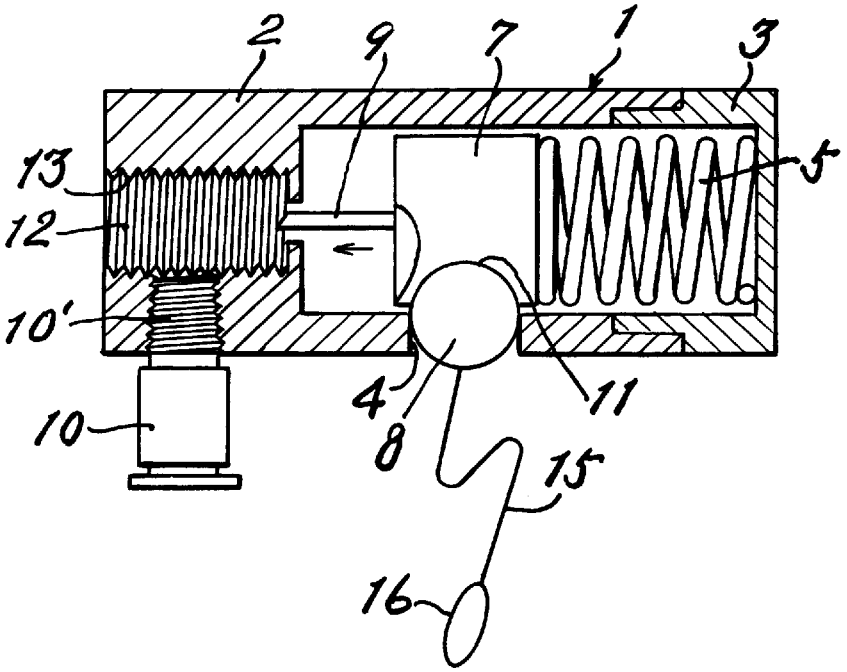
FIG. 5 is a vertical longitudinal sectional view of the second embodiment shown in FIG. 4.
Figure 6:
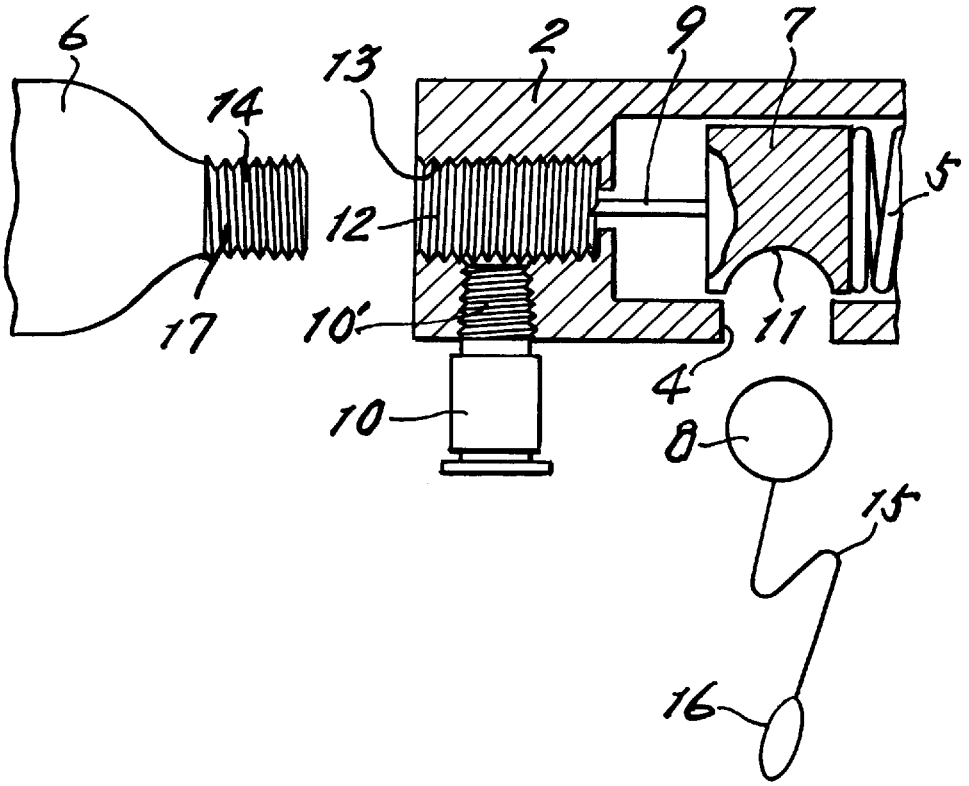
FIG. 6 is an exploded sectional view of one portion of FIG. 5.

In the second embodiment of the gas generating apparatus of this invention shown in FIG. 4 to FIG. 6, a gas generator body 1 is made of a component of stainless steel, aluminum, or synthetic resin, and comprises a slider receiving portion 2 and a spring receiving portion 3 which are connectable to each other. Said spring receiving portion 3 includes a spring 5 for pressing a slider 7 having a firing pin 9 mounted on one side.

Said sliding receiving portion 2 has an inserting slot 12 formed in one side for connecting a gas cartridge 6, and said inserting slot 12 is provided with an inner screw thread portion 13 and is connected to a threaded slot 10' formed in one side of the slider receiving portion 2 for connecting a gas discharge member 10. In other side of the slider receiving portion 2, the slider 7 is included slidably and has the firing pin 9 projected opposite to the gas cartridge 6 attached in the inserting slot 12 of one side of the slider receiving portion 2.

The gas cartridge 6 has a neck 17 which provided with an outer screw thread portion 14 for engaging with the inner screw thread portion 13 of the inserting slot 12, said neck 17 has a membrane mounted in the end portion, and the gas cartridge 6 is contained mainly with carbonic acid gas (CO), or nitrogen gas (N) in the inside. The gas cartridge 6 is attached to the slider receiving portion 2 opposite to the firing pin 9 fixed in the slider 7 by engaging the outer screw thread portion 14 of the neck 17 to the inner screw thread portion 13 of the inserting slot 12. When the slider 7 with the firing pin 9 is pressed by the spring 5 toward the gas cartridge 6, the slider 7 strikes the firing pin 9 against the membrane of the neck 17 of the gas cartridge 6, and consequently the membrane of the neck 17 is broken to generate the gas from the gas cartridge 6.

The slider 7 has an arcuated recess 11 formed in the periphery, and the slider receiving 2 has a circular opening 4 bored in the peripheral wall. A movable ball-shaped pin 8 is inserted through the opening 4 of the slider receiving portion 2 into the arcuated recess 11 of the slider 7, and the slider 7 and the firing pin 9 are maintained to a standstill position spaced from the gas cartridge 6 at the condition pressed by the spring 5 to the direction shown by arrow mark in FIG. 5.

A pulling rope 15 is connected to the circular surface of the movable ball-shaped pin 8 and has a knob 16 mounted in the end portion for pulling the rope 15 to the desired various directions.

In the second embodiment, the slider 7 is projected by the pressure of the spring 5 toward the gas cartridge 6 when the movable ball-shaped pin 8 is released from the arcuated recess 11 of the slider 7, the membrane in the neck 17 of the gas cartridge 6 is broken by the firing pin 9 mounted to the slider 7, and consequently the gas is generated from the gas cartridge 6 and is poured into the life jacket 18 through the gas discharging member 10.

The gas generating apparatus according to this invention is attached to the emergency refuge implements, such as a life jacket, life boat, life buoy, air pump for tires of motor bicycles and vehicles, and air bag and can generate rapidly and surely the gas from the gas cartridge by pulling the knob to the desired various directions and can pour easily into the emergency refuge implements of the life jacket, etc., the construction of the gas generating apparatus is very compact and light weight in the whole, and further the gas generating manipulation is very easy.

What is claimed is:

1. A gas generating apparatus for use with emergency refuge implements, said apparatus comprising:

a gas generator body including a spring receiving portion and a gas cartridge receiving portion;

a slider and a gas cartridge connected to said slider slidably mounted in one side of said gas cartridge receiving portion;

another side of said gas cartridge receiving portion having a firing pin extending in a direction toward said gas cartridge, and a gas discharging member adjacent to said firing pin;

a spring in said spring receiving portion and acting on said gas cartridge to impart a force thereon to urge said gas cartridge toward said firing pin;

a pin removably inserted through a hole in said gas cartridge receiving portion into a recess in said slider, thereby to maintain, against a pressing force of said spring, said slider and said gas cartridge in a standby position spaced from said firing pin; and a removal member connected to said pin for removing said pin from said recess.

2. An apparatus as claimed in claim 1, wherein said gas cartridge is threadably engaged in a passage extending through said slider.

3. An apparatus as claimed in claim 1, wherein said gas cartridge has at an end thereof directed toward said firing pin a membrane to be pierced by said firing pin.

4. An apparatus as claimed in claim 1, wherein said recess is arcuate, and said pin is ball-shaped.

5. An apparatus as claimed in claim 1, wherein said removal member comprises a pulling rope having a knob connected thereto.

6. A gas generating apparatus for use with emergency refuge implements, said apparatus comprising:

a gas generator body including a spring receiving portion and a slider receiving portion;

one side of said slider receiving portion having a gas cartridge and a gas discharge member adjacent to said gas cartridge;

a slider slidably mounted in another side of said slider receiving portion, said slider having a firing pin extending in a direction toward said gas cartridge, and said slider having a side recess;

a spring in said spring receiving portion and acting on said slider to impart a force thereon to urge said slider toward gas cartridge;

a pin removably inserted through a hole in said slider receiving portion into said recess in said slider, thereby to maintain, against a pressing force of said spring, said slider and firing pin in a standby position spaced from said gas cartridge; and a removal member connected to said pin for removing said pin from said recess.

7. An apparatus as claimed in claim 6, wherein said gas cartridge is threadably engaged in a passage extending through said one end of said slider receiving portion.

8. An apparatus as claimed in claim 6, wherein said gas cartridge has at an end thereof directed toward said firing pin a membrane to be pierced by said firing pin.

9. An apparatus as claimed in claim 6, wherein said recess is arcuate, and said pin is ball-shaped.

10. An apparatus as claimed in claim 6, wherein said removal member comprises a pulling rope having a knob connected thereto.

11. An apparatus as claimed in claim 6, wherein said spring acts on an end of said slider opposite to an end thereof directed toward said gas cartridge.

* * * * *